US007748142B2

(12) United States Patent
Fusco

(10) Patent No.: US 7,748,142 B2
(45) Date of Patent: Jul. 6, 2010

(54) ARTICLE OF FOOTWEAR FOR LONG JUMPING

(75) Inventor: Ciro Fusco, Portland (IT)

(73) Assignee: NIKE, Inc., Beaverton, OR (US)

( * ) Notice: Subject to any disclaimer, the term of this patent is extended or adjusted under 35 U.S.C. 154(b) by 893 days.

(21) Appl. No.: 11/535,158

(22) Filed: Sep. 26, 2006

(65) Prior Publication Data

US 2008/0072462 A1 Mar. 27, 2008

(51) Int. Cl.
*A43B 13/28* (2006.01)

(52) U.S. Cl. ..... 36/28; 36/27

(58) Field of Classification Search ..... 36/27, 36/28, 29, 35 B

See application file for complete search history.

(56) References Cited

U.S. PATENT DOCUMENTS 2,100,492 A * 11/1937 Sindler ..... 36/29
2,627,676 A * 2/1953 Hack ..... 36/29
3,719,965 A * 3/1973 Chevallereau ..... 12/146 B
4,183,156 A 1/1980 Rudy
4,219,945 A 9/1980 Rudy
4,255,877 A 3/1981 Bowerman
4,287,675 A 9/1981 Norton et al.
4,288,929 A 9/1981 Norton et al.
4,354,318 A 10/1982 Frederick et al.
4,364,188 A 12/1982 Turner et al.
4,364,189 A 12/1982 Bates
4,492,046 A 1/1985 Kosova
4,559,724 A 12/1985 Norton
4,566,206 A 1/1986 Weber
4,593,482 A * 6/1986 Mayer ..... 36/7.5
4,670,995 A 6/1987 Huang
4,864,738 A * 9/1989 Horovitz ..... 36/29
4,949,476 A 8/1990 Anderie
5,005,300 A * 4/1991 Diaz et al. ..... 36/114
5,117,566 A * 6/1992 Lloyd et al. ..... 36/29
5,159,767 A 11/1992 Allen
5,203,095 A 4/1993 Allen
5,247,742 A 9/1993 Kilgore et al.
5,343,639 A 9/1994 Kilgore et al.
5,353,523 A 10/1994 Kilgore et al.
5,367,790 A 11/1994 Gamow et al.
5,381,607 A 1/1995 Sussmann
5,701,686 A 12/1997 Herr et al.
5,713,141 A * 2/1998 Mitchell et al. ..... 36/29
5,901,467 A * 5/1999 Peterson et al. ..... 36/29
6,029,374 A 2/2000 Herr et al.
6,601,042 B1 5/2000 Lyden
6,397,498 B1 * 6/2002 Yoo ..... 36/132
6,449,878 B1 9/2002 Lyden
6,857,205 B1 2/2005 Fusco et al.

(Continued)

OTHER PUBLICATIONS

PCT/US07/75452—Search Report dated Jan. 28, 2008.

*Primary Examiner*—Marie Patterson
(74) *Attorney, Agent, or Firm*—Banner & Witcoff, Ltd.

(57) ABSTRACT

An article of footwear includes an upper and a sole assembly secured to the upper and including a support assembly. The support assembly includes a plate positioned beneath the upper and a plurality of transversely extending elliptical tubular members positioned beneath the plate. At least one of the tubular members is formed of a first portion, a second portion spaced from the first portion by a first longitudinal gap, and a third portion spaced from the second portion by a second longitudinal gap.

19 Claims, 4 Drawing Sheets

U.S. PATENT DOCUMENTS

| | | | | |
|---|---|---|---|---|
| 7,100,309 | B2 | 9/2006 | Smith et al. | |
| 7,181,866 | B2 * | 2/2007 | Braunschweiler | 36/28 |
| 7,334,351 | B2 * | 2/2008 | Hann | 36/27 |
| 2003/0069807 | A1 | 4/2003 | Lyden | |
| 2004/0154189 | A1 * | 8/2004 | Wang | 36/28 |
| 2005/0252038 | A1 * | 11/2005 | Braunschweiler | 36/28 |
| 2006/0236562 | A1 * | 10/2006 | Wang | 36/29 |
| 2007/0113425 | A1 * | 5/2007 | Wakley et al. | 36/28 |
| 2008/0098619 | A1 * | 5/2008 | Smaldone et al. | 36/28 |

* cited by examiner

ARTICLE OF FOOTWEAR FOR LONG JUMPING

FIELD OF THE INVENTION

This invention relates generally to footwear, and, in particular, to an article of footwear suitable for long jumping.

BACKGROUND OF THE INVENTION

The long jump competition, a track and field sporting event, involves three distinct phases: sprinting, launching, and soaring. Initially, an athlete sprints toward a foul line that is positioned before a landing pit. Before the competitor's feet cross the foul line, the competitor launches or jumps upward from a board, typically formed of wood, thereby becoming airborne. Finally, the competitor soars through the air and over and into the landing pit in an attempt to have the greatest soaring distance, which is measured from the foul line to the competitor's first point of contact with the landing pit.

In comparison with other track and field sporting events, the long jump competition induces the greatest forces in the foot, particularly during the launch phase. As the athlete sprints toward the foul line, forces experienced by the foot are substantially similar to forces experienced during other track and field events that involve sprinting. Immediately before the foul line, and while sprinting, the athlete places one of the feet upon the ground and presses upward with the leg to provide a forceful launch. During the launch, therefore, the foot not only experiences sprinting forces, but also experiences forces associated with the upward press. The combination of these forces has the potential to be greater than the forces experienced by the foot during any other track and field sporting event.

Conventional articles of footwear intended to be utilized during the long jump competition include an upper that receives the foot and a sole structure that is attached to the upper. The sole structure typically includes a midsole, an outsole, and a traction plate. The midsole is positioned adjacent to the foot and may be manufactured from polyurethane or ethylvinylacetate foam. The outsole is attached to the lower surface of the midsole and may be formed from a durable, wear-resistant material, such as rubber. The traction plate, a semi-rigid element attached to the outsole in the forefoot region of the footwear, includes both texturing and removable gripping elements such as metal spikes to enhance traction.

The optimal launch angle for a long jumper is 45°. However, the typical launch angle for a long jumper using conventional long jumping footwear is in the range of approximately 30-35°. It would be desirable to provide an article of footwear with an improved structure that helps to improve the launch angle such that it increases beyond that provided by conventional long jumping footwear. It would also be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear suitable for use in long jumping. Substantial advantage is achieved by providing an article of footwear for long jumping. In particular, certain embodiments provide an article of footwear that helps increase the launch angle of the center of mass of the long jumper.

These and additional features and advantages disclosed here will be further understood from the following detailed disclosure of certain embodiments.

Figure 1:
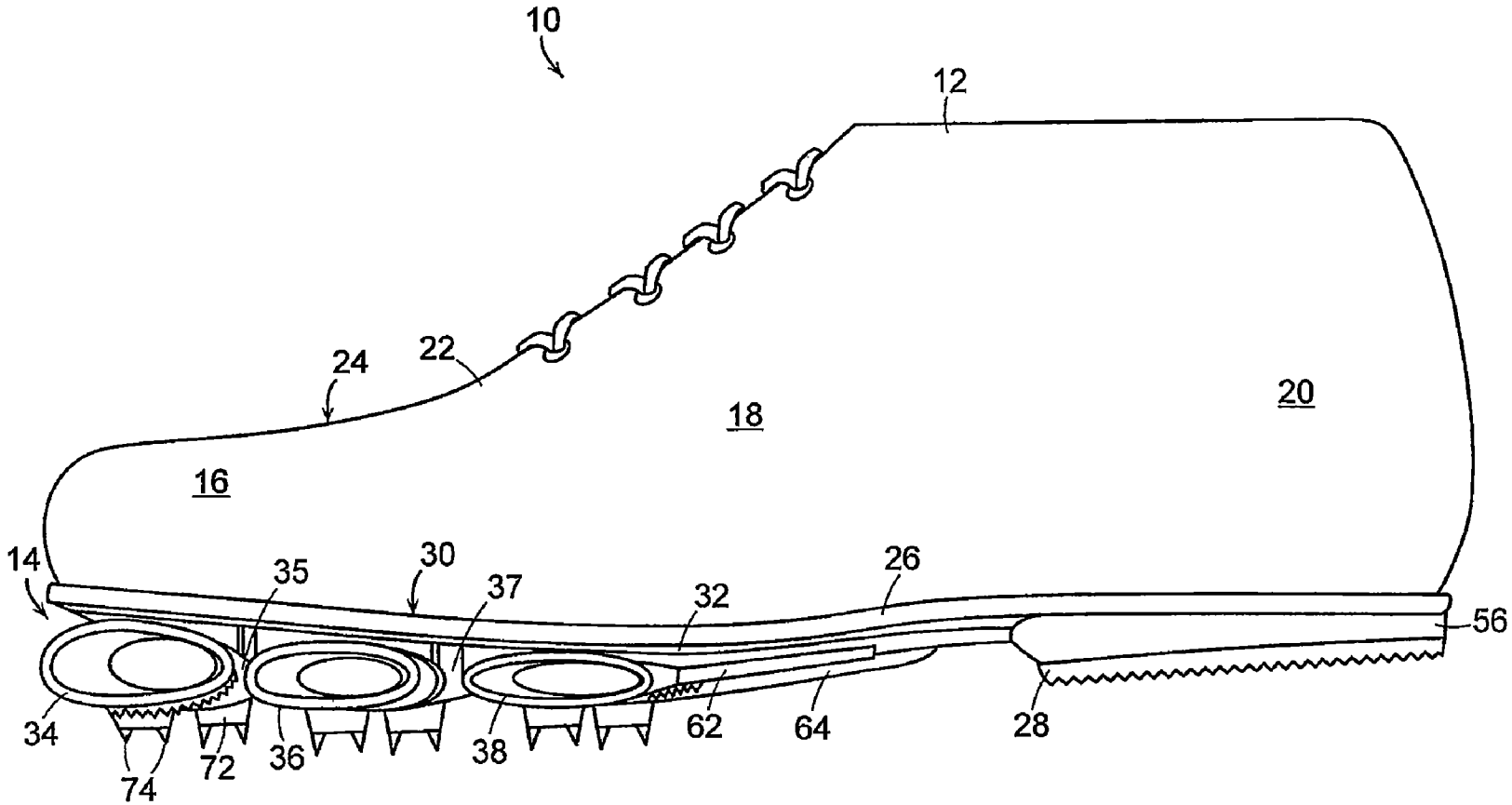
FIG. 1 is an elevation view of an article of footwear with a support assembly having tubular members and spikes in a forefoot area thereof.

The figures referred to above are not drawn necessarily to scale and should be understood to provide a representation of the invention, illustrative of the principles involved. Some features of the article of footwear for long jumping depicted in the drawings have been enlarged or distorted relative to others to facilitate explanation and understanding. The same reference numbers are used in the drawings for similar or identical components and features shown in various alternative embodiments. Articles of footwear for long jumping as disclosed herein would have configurations and components determined, in part, by the intended application and environment in which they are used.

DETAILED DESCRIPTION OF CERTAIN PREFERRED EMBODIMENTS

The following discussion and accompanying figures disclose an article of footwear 10 in accordance with aspects of the present invention. Footwear 10 is depicted in the figures and discussed below as having a configuration that is suitable for long jumping. The concepts disclosed with respect to footwear 10 may, however, be applied to footwear styles that are specifically designed for other athletic activities. Accordingly, one skilled in the relevant art will recognize that the concepts disclosed herein may be applied to other footwear styles and are not limited to the specific embodiments discussed below and depicted in the figures.

Figure 2:
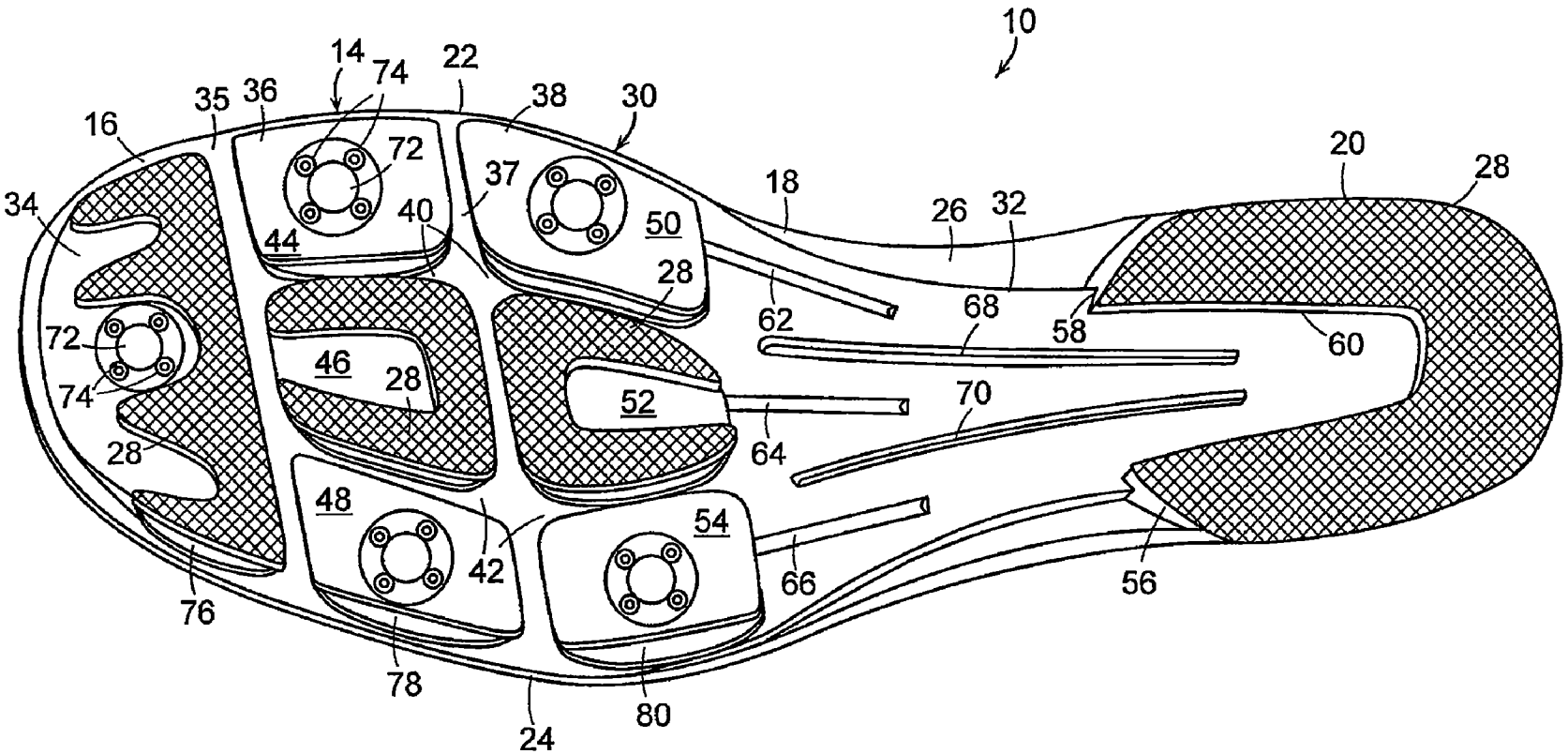
FIG. 2 is perspective view of the bottom of the article of footwear of FIG. 1.

Footwear 10 is depicted in FIGS. 1-2 and includes an upper 12 and a sole assembly 14. For purposes of reference, footwear 10 may be divided into three general regions: a forefoot region 16, a midfoot region 18, and a heel region 20, as defined in FIG. 1. Forefoot region 16 generally includes portions of footwear 10 corresponding with the toes and the joints connecting the metatarsals with the phalanges. Midfoot region 18 generally includes portions of footwear 10 corresponding with the arch area of the foot, and heel region 20 corresponds with rear portions of the foot, including the calcaneus bone. Footwear 10 also includes a medial side 22 and an opposite lateral side 24. Medial side 22 and lateral side 24 extend through each of regions 16-20 and correspond with opposite sides of footwear 10.

Regions 16-20 and sides 22-24 are not intended to demarcate precise areas of footwear 10. Rather, regions 16-20 and sides 22-24 are intended to represent general areas of footwear 10 that provide a frame of reference during the following discussion. Although regions 16-20 and sides 22-24 apply generally to footwear 10, references to regions 16-20 and sides 22-24 may also apply specifically to upper 12, sole assembly 14, or an individual component or portion within either of upper 12 or sole assembly 14, or any other component of footwear 10.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Upper 12 is formed from various material elements that are stitched or adhesively-bonded together to form an interior void that comfortably receives a foot and secures the position of the foot relative to sole assembly 14. A variety of materials are suitable for upper 12, including the materials that are conventionally utilized in footwear uppers. Accordingly, upper 12 may be formed from combinations of leather, synthetic leather, natural or synthetic textiles, polymer sheets, polymer foams, mesh textiles, felts, non-woven polymers, or rubber materials, for example. The interior of upper 12 may have foam elements for enhancing the comfort of footwear 10, and the interior surface may include a moisture-wicking textile for removing excess moisture from the area immediately surrounding the foot.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 includes an insole (not shown) located within upper 12, a midsole 26, and an outsole 28. Midsole 26 is attached to upper 22 and functions as the primary shock-attenuating and energy-absorbing component of footwear 10. Suitable materials for midsole 26 are any of the conventional polymer foams that are utilized in footwear midsoles, including ethylvinylacetate (EVA) and polyurethane (PU) foam.

Outsole 28 is secured to a lower surface of midsole 26 to provide wear-resistance. In addition, outsole 28 may be textured to enhance the traction (e.g., friction) properties between footwear 10 and the ground. Suitable materials for outsole 28 include any of the conventional rubber materials that are utilized in footwear outsoles, such as carbon black rubber compound. Other suitable materials for outsole 28 will become readily apparent to those skilled in the art, given the benefit of this disclosure.

Sole assembly 14 includes a support assembly 30 having a plate 32 positioned beneath midsole 26. Plate 32 may be secured to midsole 26 with adhesive or any other suitable fastening means. Plate 32 is formed of a relatively stiff, yet flexible material. Plate 32 may be formed, for example, of nylon resins or glass-filled nylon, such as Zytel®, sold by Dupont. Other suitable materials for plate 32 will become readily apparent to those skilled in the art, given the benefit of this disclosure.

In certain embodiments, plate 32 extends across substantially the entire lower surface of midsole 26. In other embodiments, plate 32 may not cover the entire lower surface of midsole 26. In the embodiment illustrated in FIG. 2, plate 32 is slightly narrower than midsole 26 in midfoot portion 18 and heel portion 20 of sole assembly 14. Reducing the size of plate 32 can help reduce the weight of footwear 10, and may provide aesthetic appeal as well.

A plurality of tubular members is provided beneath plate 32 and extend transversely across sole assembly 14. In the illustrated embodiment, a first tubular member 34 is positioned in a front of forefoot portion 16 of sole assembly 14. A second tubular member 36 is positioned slightly rearwardly or behind first tubular member 34, with a first transverse gap 35 provided therebetween. A third tubular member 38 is positioned slightly rearwardly or behind second tubular member 36, with a second transverse gap 37 provided therebetween.

First transverse gap 35 and second transverse gap 37 provide for bending or articulation of sole assembly 14 in forefoot portion 16, thereby improving the flexibility of footwear 10.

In certain embodiments, as illustrated here, tubular members 34, 36, 38 are of unitary, that is, one-piece, construction with plate 32. In other embodiments, tubular members 34, 36, 38 may be separate elements secured to plate 32 with adhesive or other suitable fastening means.

In certain embodiments, tubular members 34, 36, 38 are substantially elliptical in cross-section, as illustrated in FIG. 1, with their major axes extending substantially longitudinally along plate 32 and their minor axes extending substantially vertically. Tubular members 34, 36, 38 are joined on their upper surface to plate 32 either in one-piece fashion, as discussed above, or secured thereto with adhesive or other suitable fastening means.

In certain embodiments, the height of each tubular member 34, 36, 38, that is, its vertical dimension along its minor axis, is different than that of the other tubular members, with the heights decreasing from the front of forefoot portion 16 toward heel portion 20 of sole assembly 14. Suitable sizes for tubular members 34, 36, 38 will become readily apparent to those skilled in the art, given the benefit of this disclosure.

As illustrated here, where three tubular members 34, 36, 38 are shown, first tubular member 34 has a first greatest height, second tubular member 36 has a second height that is less than the first height of first tubular member 34, and third tubular member 38 has a third height that is less than the second height of second tubular member 36. Thus, as can be seen most clearly in FIG. 1, the decreasing height of tubular members 34, 36, 38 from the front of forefoot portion 16 toward heel portion 20 forms a wedge-like structure. This wedge-like structure helps to orient the long jumper's foot at launch, helping the center of mass of the jumper get closer to the optimal 450 launch angle.

Although the illustrated embodiment shows three tubular elements extending transversely across sole assembly 14, it is to be appreciated that any number of tubular elements can be provided in sole assembly 14.

As illustrated here, each of tubular elements 34, 36, 38 are positioned in forefoot portion 16 of sole assembly 14 in order to facilitate launch. It is to be appreciated that portions of one or more tubular elements may be positioned in other portions of sole assembly 14, such as midfoot portion 18, for example.

As illustrated here most clearly in FIG. 2, tubular members 34, 36, 38 are substantially parallel to one another as they extend transversely across sole assembly 14. It is to be appreciated that in other embodiments, tubular members 34, 36, 38 need not necessarily be parallel to one another, but, alternatively, each tubular member could be oriented in non-parallel fashion with respect to one or more of the other tubular members.

As can be seen in FIG. 2, second tubular member 36 and third tubular member 38 are each split into three individual portions by a first longitudinal gap 40 and a second longitudinal gap 42 spaced from first longitudinal gap 40. First longitudinal gap 40 is positioned in the medial half 22 of sole assembly 14 and is slightly concave toward the center of sole assembly 14 and second longitudinal gap 42. Second longitudinal gap 42 is positioned in the lateral half 24 of sole assembly 14 and is slightly concave toward the center of sole assembly 14 and first longitudinal gap 40.

Thus, second tubular element 36 is split by first longitudinal gap 40 and second longitudinal gap 42 into a first portion 44, a second portion 46, and a third portion 48. First portion 44 is located in medial portion 22 of sole assembly 14, second portion 46 is located in a central portion of sole assembly 14, and third portion 48 is located in lateral portion 24 of sole assembly 14. Thus, first longitudinal gap 40 is positioned between first portion 44 and second portion 46, and second longitudinal gap 42 is positioned between second portion 46 and third portion 48.

Similarly, third tubular element 38 is split by first longitudinal gap 40 and second longitudinal gap 42 into a first portion 50, a second portion 52, and a third portion 54. First portion 50 is located in medial portion 22 of sole assembly 14, second portion 52 is located in a central portion of sole assembly 14, and third portion 54 is located in lateral portion 24 of sole assembly 14. Thus, first longitudinal gap 40 is positioned between first portion 50 and second portion 52, and second longitudinal gap 42 is positioned between second portion 52 and third portion 54.

It is to be appreciated that some or all of the tubular elements of sole assembly 14 can be split by the longitudinal gaps in other embodiments.

By providing first and second longitudinal gaps 40, 42 and diving second and third tubular members 36, 38 into three portions, sole assembly 14 is allowed to splay at launch, helping to naturally dissipate the excessive forces experienced at launch.

A heel pad 56 is positioned in heel portion 20 of sole assembly 14 beneath midsole 26. An upper surface of heel pad 56 is secured to midsole 26 by adhesive or other suitable fastening means. A recess 58 is formed in an upper surface of heel pad 56 and receives a heel portion of plate 32. In the illustrated embodiment, heel pad 56 is substantially C-shaped so as to define a recess 60, with its open end facing the front of sole assembly 14. By forming recess 60 in heel pad 56, the weight of heel pad 56 can be reduced, while still providing sufficient support and structure in heel portion 20.

A first rib 62 extends rearwardly along the lower surface of plate 32 from a rear edge of first portion 50 of third tubular member 38 into midfoot portion 18 of plate 32. A second rib 66 extends rearwardly along the lower surface of plate 32 from a rear edge of second portion 52 of third tubular member 38 into midfoot portion 18 of plate 32. A third rib 68 extends rearwardly along the lower surface of plate 32 from a rear edge of third portion 54 of third tubular member 38 into midfoot portion 18 of plate 32. Ribs 62, 64, and 66 serve to increase the rigidity of plate 32 in its midfoot portion 18. It is to be appreciated that the lengths of ribs 62, 64, and 66 can vary, and they may, in certain embodiments, extend into heel portion 20.

A first groove or slot 68 is formed in medial portion 22 of plate 32 and extends from midfoot portion 18 into heel portion 20 of plate 32. A second groove or slot 70 is formed in lateral portion 24 of plate 32 and extends from midfoot portion 18 into heel portion 20 of plate 32. Slots 68, 70 serve to reduce the weight of plate 32, and can provide aesthetic appeal.

A plurality of gripping elements 72 are provided on the lower surface of plate 32. Each gripping element 72 includes a plurality of downwardly projecting spikes 74. In the illustrated embodiment, each gripping element 72 has four spikes 74. In the illustrated embodiment, a gripping element 72 is provided in a central portion of first tubular member 34. A gripping element 72 is provided in a central portion of each of first and third portions 44, 48 of second tubular member 36. Similarly, a gripping element 72 is provided in a central portion of each of first and third portions 50, 54 of third tubular member 38. Spikes 74 may be formed of metal or any other material suitable for providing increased traction for the long jumper. Gripping elements 72 and/or spikes 74 may be removable or permanently secured to sole assembly 14.

In certain embodiments, outsole 28 is formed of a plurality of outsole elements 28 secured to a lower surface of plate 32 and tubular elements 34, 36, and 38. In the illustrated embodiment, an outsole element 28 is provided on each of first tubular element 34, second portion 46 of second tubular element 36, second portion 52 of third tubular element 38, and heel pad 56. Outsole elements 28 may have any desired shape. For example, the outsole elements 28 on second portion 46 and second portion 52 are substantially C-shaped, opening toward forefoot portion 16 and heel portion 20, respectively. Outsole elements 28 may have a textured surface in any desired pattern to reduce slipping and increase traction for the user.

Outsole elements 28 may be formed of rubber or other material suitable for providing increased traction. In certain embodiments, outsole elements 28 are formed of poly-butadiene rubber with a small percentage of acrylonitrile-butadiene rubber. In certain embodiments, the rubber tray include 0.5 parts of a green silane. The rubber may include a granule-based silica as a filler. Since such a mixture is not a carbon black based formula, it can be colored.

Figure 3:
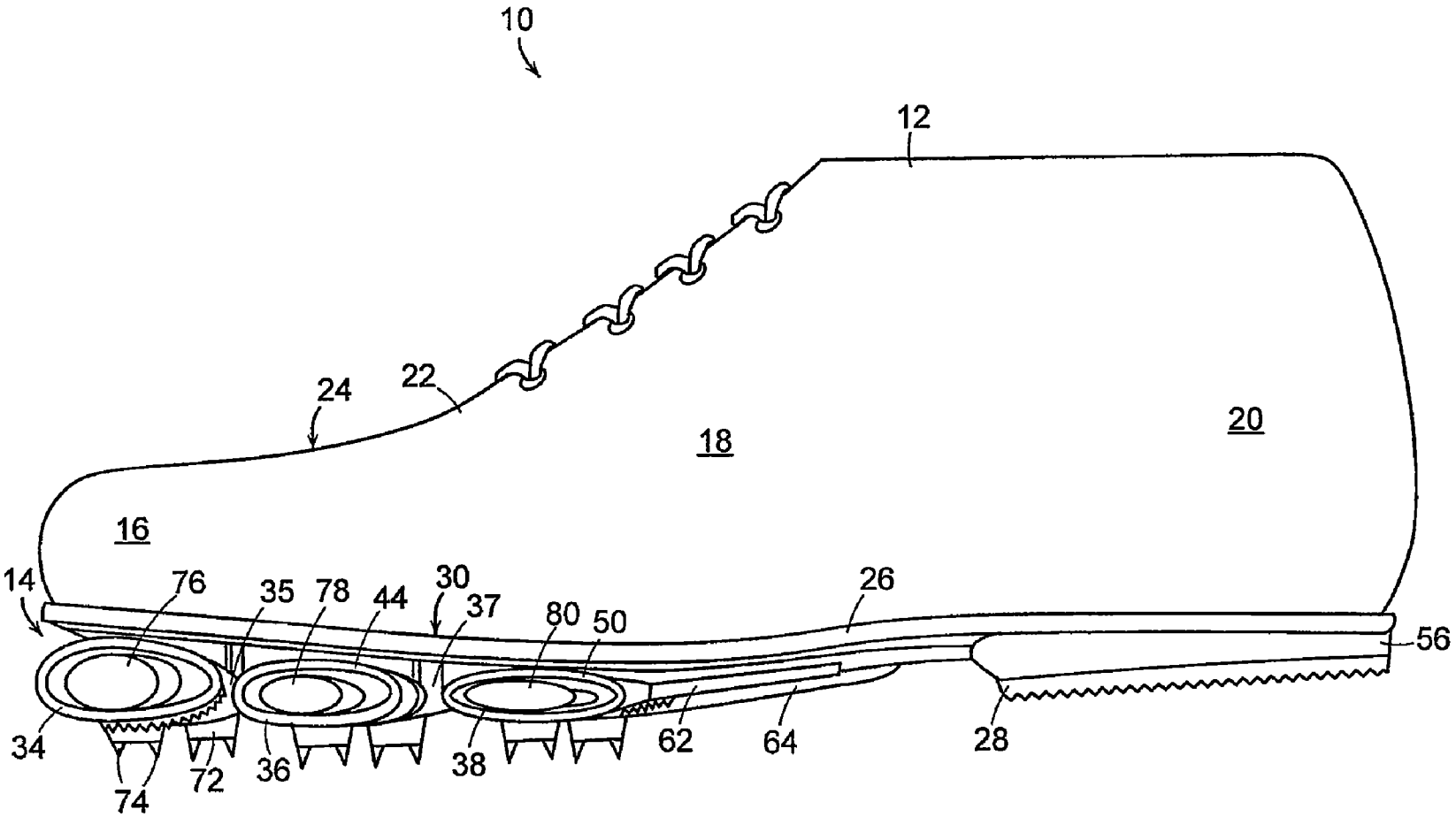
FIG. 3 is an elevation view of an alternative embodiment of an article of footwear with a support assembly having tubular members and spikes in a forefoot area thereof.
Figure 4:
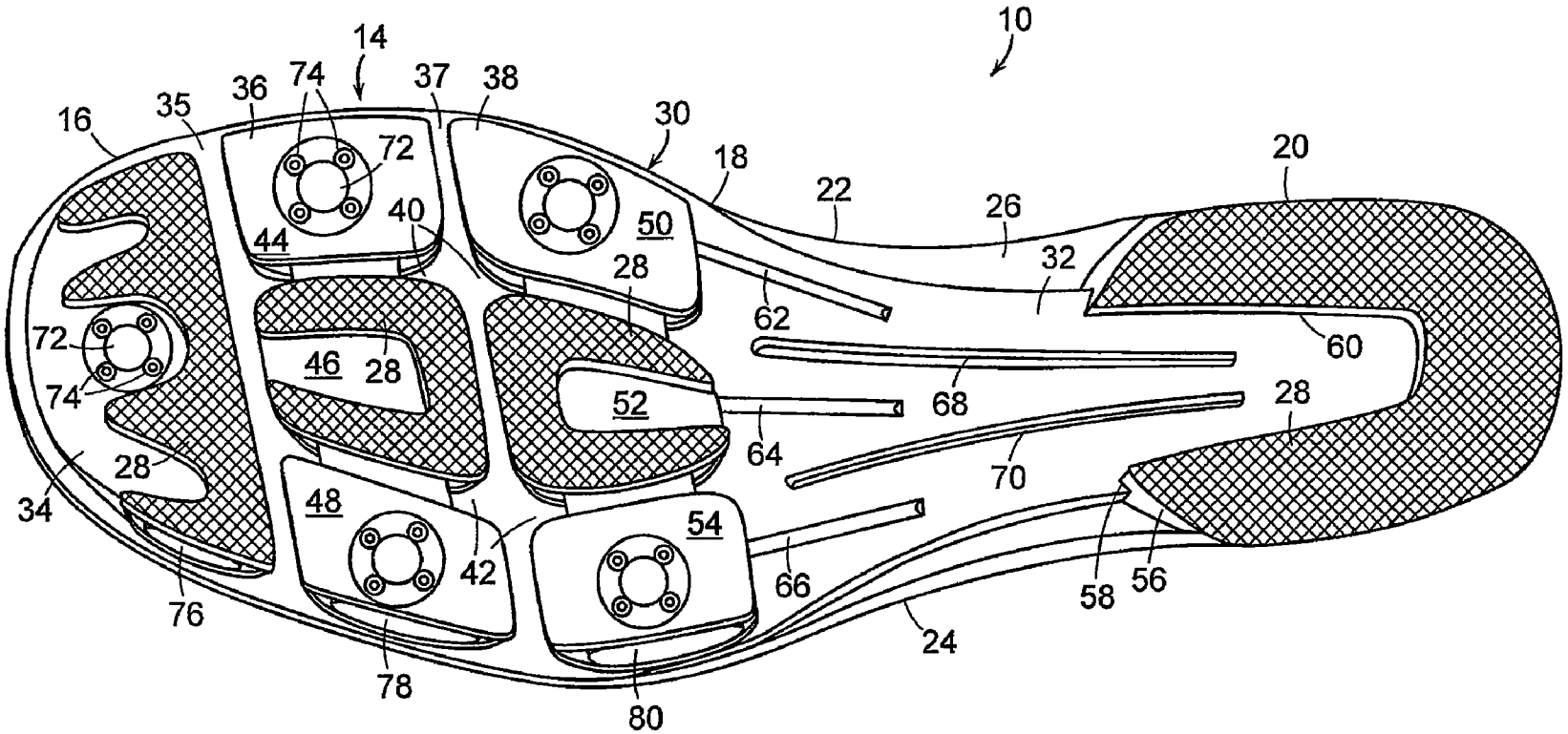
FIG. 4 is perspective view of the bottom of the article of footwear of FIG. 3.

Another embodiment is shown in FIGS. 3-4, in which an insert is provided in each tubular member. Specifically, a first insert 76 extends through first tubular member 34. A second insert 78 extends through second tubular member 36, passing through each of first portion 44, second portion 46 and third portion 48. A third insert 80 extends through third tubular member 38, passing through each of first portion 50, second portion 52, and third portion 54.

First, second and third inserts 76, 78, 80 provide additional cushioning and support in forefoot portion 16 of sole assembly 14. First, second and third inserts 76, 78, 80 may be formed of EVA or PU, for example.

In certain embodiments, as seen in FIG. 4, the height of each insert 76, 78, 80, that is, its dimension along its minor axis, is the same as the internal height of the corresponding tubular members. The width of inserts 76, 78, 80 can vary with respect to the corresponding tubular members. In certain embodiments, as illustrated here, the width of first, second and third inserts 76, 78, 80 is less than the internal widths of corresponding first, second and third tubular members 34, 36, and 38, such that a space or gap is provided in front of and behind each insert. It is to be appreciated that inserts 76, 78, 80 could totally fill the internal space of corresponding first, second and third tubular members 34, 36, and 38 in certain embodiments.

First, second, and third inserts 76, 78, 80 may be secured to corresponding first, second and third tubular members 34, 36, 38 by adhesive. In certain embodiments, inserts 76, 78, 80 may be directly injected onto tubular members 34, 36, 38 such that a bond is created between the inserts and the tubular members.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper; and a sole assembly secured to the upper and including a support assembly, the support assembly comprising:

a plate positioned beneath the upper;

a plurality of transversely extending tubular members elliptical in cross-section and positioned beneath the plate, at least one of the tubular members being formed of a first portion, a second portion spaced from the first portion by a first longitudinal gap, and a third portion spaced from the second portion by a second longitudinal gap;

a plurality of gripping elements, each gripping element extending downwardly from one of the tubular members; and a plurality of inserts, each insert extending through one of the tubular members.

2. The article of footwear of claim 1, wherein the tubular members are of unitary construction with the plate.

3. The article of footwear of claim 1, wherein a height of each tubular member is different than a height of each of the other tubular members.

4. The article of footwear of claim 1, wherein a height of the plurality of tubular members decreases along a length of the plate.

5. The article of footwear of claim 1, wherein each of the tubular members is provided in a forefoot portion of the sole assembly.

6. The article of footwear of claim 1, further comprising a heel pad secured to a bottom surface of a heel portion of the plate.

7. The article of footwear of claim 6, wherein the heel pad is substantially C-shaped with an open end facing a front portion of the sole assembly.

8. The article of footwear of claim 1, further comprising a plurality of ribs extending along a lower surface of the plate.

9. The article of footwear of claim 8, wherein each of the tubular members is positioned in a forefoot portion of the plate and the ribs extend rearwardly away from the tubular members in a midfoot portion of the plate.

10. The article of footwear of claim 1, further comprising a plurality of slots formed in the plate.

11. The article of footwear of claim 10, wherein each of the tubular members is positioned in a forefoot portion of the plate and the slots extend between a midfoot portion of the plate and a heel portion of the plate.

12. The article of footwear of claim 1, wherein the inserts are secured to the tubular members.

13. The article of footwear of claim 1, wherein the tubular members extend substantially parallel to one another.

14. The article of footwear of claim 1, wherein the gripping elements include downwardly projecting spikes.

15. The article of footwear of claim 1, wherein the sole assembly includes a first tubular member, a second tubular member positioned rearwardly of the first tubular member, and a third tubular member positioned rearwardly of the second tubular member, each of the second and third tubular members being formed of a first portion, a second portion spaced from the first portion by a first longitudinal gap, and a third portion spaced from the second portion by a second longitudinal gap.

16. The article of footwear of claim 1, further comprising a plurality of outsole elements, each outsole element being secured to a lower surface of one of the plate and the tubular members.

17. An article of footwear comprising, in combination:

an upper; and a sole assembly secured to the upper and including a support assembly, the support assembly comprising:

a plate positioned beneath the upper;

a first transversely extending tubular member elliptical in cross-section and positioned beneath the plate in a forefoot portion of the sole assembly;

a second transversely extending tubular member, elliptical in cross-section, behind the first tubular member and spaced therefrom by a first transverse gap and comprising a first portion, a second portion, and a third portion; and a third transversely extending tubular member, elliptical in cross-section, behind the second tubular member and spaced therefrom by a second transverse gap and comprising a first portion, a second portion, and a third portion;

a first longitudinal gap separating the first portion of the second tubular member from the second portion of the second tubular member and the first portion of the third tubular member from the second portion of the third tubular member;

a second longitudinal gap separating the second portion of the second tubular member from the third portion of the second tubular member and the second portion of the third tubular member from the third portion of the third tubular member;

a plurality of gripping elements, each gripping element extending downwardly from one of the tubular members; and a plurality of inserts, each insert extending through one of the tubular members.

18. The article of footwear of claim 17, further comprising:

a first insert extending through the first tubular member;

a second insert extending through the second tubular member; and a third insert extending through the third tubular member.

19. An article of footwear comprising, in combination:

an upper; and a sole assembly secured to the upper and including a support assembly, the support assembly comprising:

a plate positioned beneath the upper;

a first transversely extending tubular member substantially elliptical in cross-section and positioned beneath the plate in a forefoot portion of the sole assembly;

a first insert substantially elliptical in cross-section and extending through the first tubular member;

a second transversely extending tubular member substantially elliptical in cross-section and behind the first tubular member and spaced therefrom by a first transverse gap and comprising a first portion, a second portion, and a third portion;

a second insert substantially elliptical in cross-section and extending through the second tubular member;

a third transversely extending tubular member substantially elliptical in cross-section and behind the second tubular member and spaced therefrom by a second transverse gap and comprising a first portion, a second portion, and a third portion;

a third insert substantially elliptical in cross-section and extending through the third tubular member;

a first longitudinal gap separating the first portion of the second tubular member from the second portion of the second tubular member and the first portion of the third tubular member from the second portion of the third tubular member;

a second longitudinal gap separating the second portion of the second tubular member from the third portion of the second tubular member and the second portion of the third tubular member from the third portion of the third tubular member;

a plurality of gripping elements, each gripping element extending downwardly from one of the tubular members; and a plurality of inserts, each insert extending through one of the tubular members.

* * * * *